US010020629B1

(12) United States Patent
Wise

(10) Patent No.: US 10,020,629 B1
(45) Date of Patent: Jul. 10, 2018

(54) HOTSTICK TOOL FOR ASSISTING LINEMEN TAPPING HIGH POWER LINES USING WEDGE TAP CONNECTORS

(71) Applicant: Adam Michael Wise, St. Clair, MI (US)

(72) Inventor: Adam Michael Wise, St. Clair, MI (US)

(73) Assignee: Adam Michael Wise, Kenockee, MI (US)

( * ) Notice: Subject to any disclaimer, the term of this patent is extended or adjusted under 35 U.S.C. 154(b) by 0 days.

(21) Appl. No.: 15/648,875

(22) Filed: Jul. 13, 2017

(51) Int. Cl.
*H01R 43/027* (2006.01)
*H01R 43/01* (2006.01)
*H01R 4/50* (2006.01)

(52) U.S. Cl.
CPC ..... *H01R 43/027* (2013.01); *H01R 4/5083* (2013.01); *H01R 43/01* (2013.01)

(58) Field of Classification Search
CPC .... B25J 1/04; H02G 7/00; H02G 7/12; H01R 43/01; H01R 43/027; H01R 4/5083
See application file for complete search history.

(56) References Cited

U.S. PATENT DOCUMENTS 2,379,433 A * 7/1945 Hemmerling ..... H01H 85/0208 29/273
5,650,594 A * 7/1997 Urnovitz ..... H01F 27/02 174/139
6,725,745 B1 * 4/2004 Palmieri ..... H01H 85/0208 81/3.8
7,775,570 B2 * 8/2010 Taylor ..... H01H 31/127 294/175
8,172,642 B2 * 5/2012 King ..... B24B 23/03 451/357
9,102,043 B2 * 8/2015 Morin ..... B25B 31/00

* cited by examiner

*Primary Examiner* — Stephen A Vu

(57) ABSTRACT

A hotstick tool for assisting a lineman tapping power lines using a wedge-type tap connector includes a primary arm including a first holder to releasably engage a C-shaped member of the wedge-type tap connector. A secondary arm includes a second holder to releasably engage a wedge member of the wedge-type tap connector. A pivoting linkage system guides movement of the secondary arm relative to the primary arm to insert the wedge member into the C-shaped member.

20 Claims, 6 Drawing Sheets

FIG. 5A
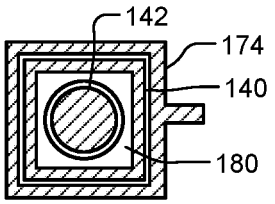
FIG. 5B
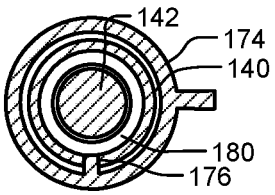
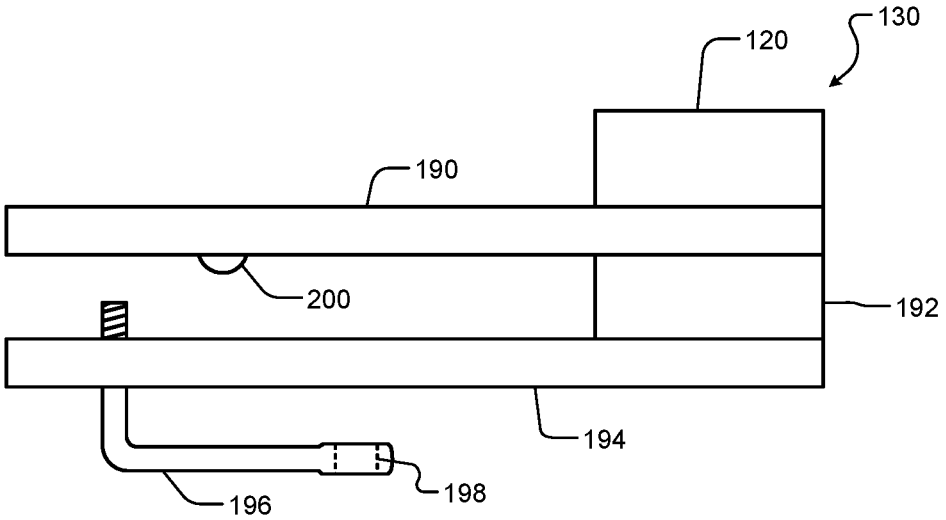
FIG. 5C

HOTSTICK TOOL FOR ASSISTING LINEMEN TAPPING HIGH POWER LINES USING WEDGE TAP CONNECTORS

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates generally to electrical connection tools, and more particularly, to a hotstick tool for assisting linemen tapping high power lines using a wedge-type tap connector.

Linemen maintain overhead and/or underground power distribution systems. Linemen use connectors to tap main power transmission lines and feed electrical power to distribution lines, sometimes referred to as tap lines. The main power line and the tap lines are typically high voltage conductors having the same or different diameters. The main power line may have a different size than the tap line. Specially designed connector components are used to connect the tap lines to the main power lines. For example, wedge-type tap connectors may be used.

Referring now to FIGS. 1A to 3B, examples of wedge-type tap connectors are shown. In FIGS. 1A-1B, the wedge-type tap connector includes a C-shaped member 50 with a C-shaped body 52 defining an opening 54 between an upper channel 56 and a lower channel 58. In FIGS. 2A-2B, a stirrup 64 may be arranged in the lower channel 58 instead of a tap line. In FIGS. 3A-3B, the wedge-type tap connector also includes a wedge member 74. The wedge member 74 includes a body 75 defining an upper groove 76 and a lower groove 78.

The upper channel 56 of the C-shaped member 50 receives a main power line and the lower channel 58 of the C-shaped member 50 receives a tap line or the stirrup 64. One side 80 of the wedge member 74 is inserted and another side 81 is driven into the C-shaped member 50. The C-shaped member 50 is deflected and the main power line and tap line or the stirrup 64 are clamped between the upper and lower grooves 76, 78 of the wedge member 74 and the upper and lower channels 56, 58 of the C-shaped member 50, respectively.

A wedge driving tool (not shown) may be used to install and uninstall the wedge member 74. The tool includes a C-shaped member, a ram and a power unit. The C-shaped member of the tool is placed transverse to and around the C-shaped member 50 and the wedge member 74. The power unit includes an explosive shell cartridge triggered by impact force. The impact force fires the shell cartridge to drive the ram into the wedge member 74, which is driven into the opening 54 of C-shaped member 50.

Given the high voltage and power involved, linemen must remain a safe distance away when tapping the power lines. The lineman wears special gloves and other safety equipment and uses specialized tools when attempting to tap the power lines using the wedge-type tap connector. For example, multiple long dielectric sticks or hotsticks with a wide variety of attachment tools can be used. The C-shaped member, the wedge connector and the wedge driving tool are all typically handled remotely using the hotsticks. Usually, two or more linemen are required to tap the main power lines due to the number of hotsticks that need to be used. Tapping the power lines may also require up to 8 different types of specialized tools, which increases the cost and the amount of time that is required to complete the job.

SUMMARY

A hotstick tool for assisting a lineman tapping power lines using a wedge-type tap connector includes a primary arm including a first holder to releasably engage a C-shaped member of the wedge-type tap connector. A secondary arm includes a second holder to releasably engage a wedge member of the wedge-type tap connector. A pivoting linkage system guides movement of the secondary arm relative to the primary arm to insert the wedge member into the C-shaped member.

In other features, the first holder includes an upper V-shaped holder that is moveable relative to the primary arm and a lower V-shaped holder that is moveable relative to the primary arm.

In other features, a shaft is located in the primary arm and includes a first threaded portion located at a distal end thereof and engaging a first threaded portion of the upper V-shaped holder and a second threaded portion arranged adjacent to the first threaded portion and engaging a second threaded portion of the upper V-shaped holder. The first threaded portion is oriented opposite to the second threaded portion such that rotation of the shaft in one direction moves the upper V-shaped holder towards the lower V-shaped holder and rotation of the shaft in an opposite direction moves the upper V-shaped holder away from the lower V-shaped holder.

In other features, the first holder includes an upper V-shaped holder that is moveable relative to the primary arm and a lower V-shaped holder that is fixed relative to the primary arm.

In other features, a shaft is located in the primary arm and including a first threaded portion located at a distal end thereof and engaging a first threaded portion of the upper V-shaped holder. Rotation of the shaft in one direction moves the upper V-shaped holder towards the lower V-shaped holder and rotation of the shaft in an opposite direction moves the upper V-shaped holder away from the lower V-shaped holder.

In other features the second holder includes a first plate connected to the secondary arm, a second plate spaced from the first plate, and a bolt received in a bore in the second plate.

In other features, the second holder includes a pivoting member including a first plate connected to the secondary arm, wherein the first plate pivots relative to a second plate.

In other features, a spring biases at least one of the first plate and the second plate in a first direction. A shaft is arranged adjacent to the secondary arm. A cam connected to a distal end of the shaft biases at least one of the first plate and the second plate in a second direction opposite to the first direction.

In other features, the pivoting linkage system includes a handle, a first linkage connected to the handle, and a first fixed pivot connected to the primary arm and pivotally connected to the first linkage.

In other features, the pivoting linkage system further includes a second fixed pivot connected to the primary arm and pivotally connected to the secondary arm and a first moving pivot slidably connected to the primary arm.

In other features, the pivoting linkage system further includes a second linkage pivotally connecting the first moving pivot and the secondary arm and a third linkage pivotally connecting the first linkage to the second linkage. The primary arm and the secondary arm are made of a dielectric material.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein:

FIG. 5A is a cross-sectional view of an example of a primary arm of FIG. 4A;

FIG. 5B is a cross-sectional view of another example of a primary arm of FIG. 4A;

FIG. 5C is a plan view illustrating an example of a second holder for releasably engaging the wedge member according to the present disclosure;

In the drawings, reference numbers may be reused to identify similar and/or identical elements.

DETAILED DESCRIPTION

A hotstick tool according to the present disclosure is used to assist linemen tapping high power lines using a wedge-type connector. The hotstick tool allows a single lineman to tap the high power lines and requires fewer tools to do so. Furthermore, the hotstick tool reduces the amount of time that is required to tap high power lines and improves efficiency.

Figure 1A:
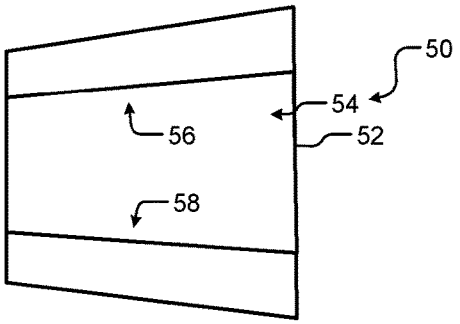
FIG. 1A Prior Art
FIGS. 1A-1B are plan and side views illustrating an example of a C-shaped member of a wedge-type tap connector according to the prior art.
Figure 1B:
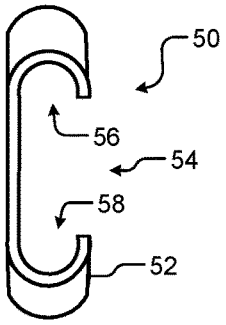
FIG. 1B Prior Art
Figure 2A:
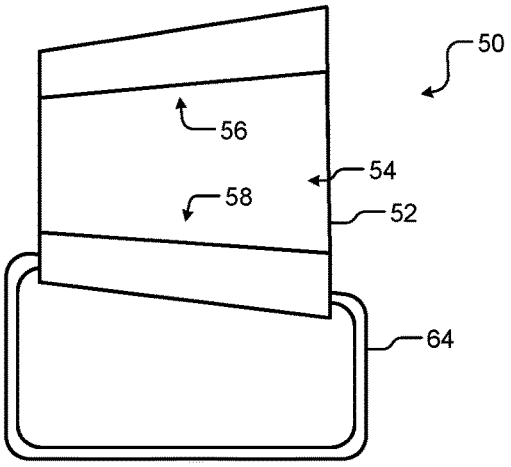
FIG. 2A Prior Art
FIGS. 2A-2B are plan and side views illustrating an example of a C-shaped member of a wedge-type tap connector that includes a stirrup according to the prior art.
Figure 2B:
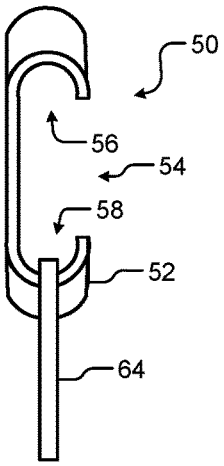
FIG. 2B Prior Art
Figure 3A:
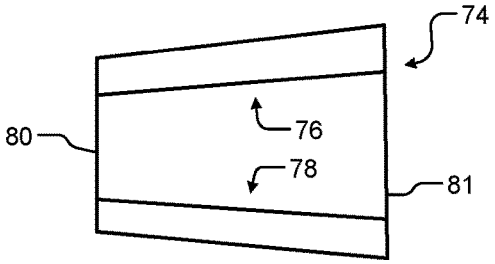
FIG. 3A Prior Art
FIGS. 3A-3B are plan and side views illustrating an example of a wedge member of a wedge-type tap connector according to the prior art.
Figure 3B:
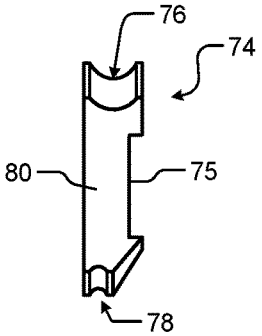
FIG. 3B Prior Art
Figure 4A:
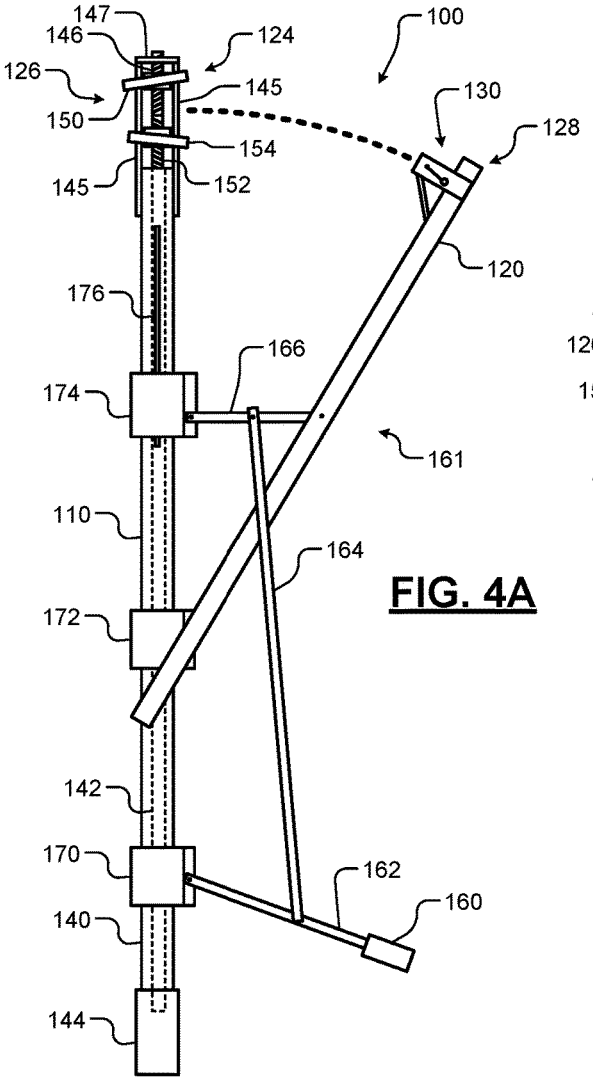
FIGS. 4A-4B are side views illustrating an example of a hotstick tool, arranged in first and second positions, respectively, for assisting a lineman when tapping power lines with a wedge-type tap connector according to the present disclosure.
Figure 4B:
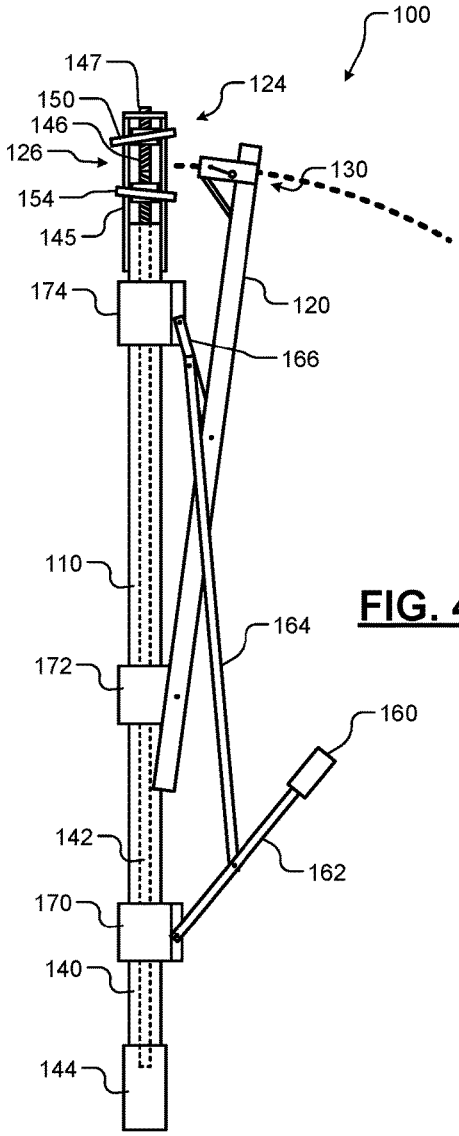

Referring now to FIGS. 4A-4B, a hotstick tool 100 is shown in a first position. The hotstick tool 100 is used to assist a lineman tapping high power transmission lines using a wedge-type tap connector. The hotstick tool 100 includes a primary arm 110 and a secondary arm 120 that pivots relative to the primary arm 110. In some examples, the primary arm 110 has a length in a range from 4 to 16 feet, although longer or shorter dimensions may be used. A distal end 124 of the primary arm 110 includes a first holder 126 to releasably engage the C-shaped member 50 (not shown in FIG. 4A). A distal end 128 of the secondary arm 120 includes a second holder 130 for releasably engaging the wedge member 74. While the hotstick tool 100 is shown opening to the right, the hotstick tool 100 can also open to the left. In other words, a mirror image of the hotstick tool 100 can also be used.

The primary arm 110 includes a housing 140 and a first shaft 142 rotatably located inside of the housing 140. A first handle 144 is arranged at a proximal end of the first shaft 142 to allow the lineman to rotate the first shaft 142. A distal end of the first shaft 142 includes a first threaded portion 146 having threads oriented in a first direction. The first threaded portion 146 is threadably engaged with an upper V-shaped holder 150 of the first holder 126. Adjacent to the first threaded portion 146 is a second threaded portion 152 that is threaded in a second direction that is opposite to the first direction. The second threaded portion 152 is threadably engaged with a lower V-shaped holder 154 of the first holder 126. In some examples, the shaft 142 may include two or more portions that are connected together to form the shaft 142. An upper portion may include the first and second threaded portions and a lower unthreaded portion may be connected thereto.

Guide plates 145 may be attached to opposite sides of the primary arm 110. Another plate 147 including a bore may be arranged at ends of the guide plates 145 to receive and guide an end of the first shaft 142 such that a location of the first shaft 142 remains fixed during rotation of the first shaft 142. The guide plates 145 also prevent rotation of the upper V-shaped holder 150 and the lower V-shaped holder 154 as the handle is rotated and both of the upper V-shaped holder 150 and the lower V-shaped holder 154 move either up or down.

As the first handle 144 is rotated in a first rotational direction, the upper V-shaped holder 150 moves towards (or away from) the lower V-shaped holder 154. As the first handle 144 is rotated in a second rotational direction (opposite to the first rotational direction), the upper V-shaped holder 150 moves away from (or towards) the lower V-shaped holder 154.

In use, the C-shaped member 50 is located between the upper V-shaped holder 150 and the lower V-shaped holder 154 and the first handle 144 is rotated until the upper V-shaped holder 150 and the lower V-shaped holder 154 engage the C-shaped member 50. The first handle 144 is later rotated in an opposite direction until the upper V-shaped holder 150 and the lower V-shaped holder 154 disengage the C-shaped member 50.

A second handle 160 is connected by a pivoting linkage system 161. The pivoting linkage system 161 moves the second holder 130 and the wedge member 74 through an arcuate path into the C-shaped member 50. In one example, the pivoting linkage system 161 includes linkages 162, 164, and 166, fixed pivots 170 and 172 on to the primary arm 110, and a moving pivot 174 on the primary arm 110. In some examples, the primary arm 110 includes a slot 176 for receiving a projection (FIG. 5B) associated with the moving pivot 174. The second handle 160 is connected by the linkage 162 to the pivot 170. A middle portion of the linkage 162 is pivotally connected to a middle portion of the linkage 166. The linkage 166 includes opposite ends connected to the moving pivot 174 and a middle portion of the secondary arm 120, which includes a lower portion that is also connected to the pivot 172.

In FIGS. 4A and 4B, it can be seen that as the second handle 160 is moved, the linkages 162, 164, 166, the fixed pivots 170 and 172 and the moving pivot 174 move the distal end 128 of the secondary arm 120 in an arcuate path towards the distal end 124 of the primary arm 110. In some examples, substantially all of the components of the hotstick tool 100 such as the primary arm, the secondary arm, the shafts, the pivot points and/or the linkages are made of dielectric material or insulating material.

Referring now to FIGS. 5A-5B, example cross-sections for the housing 140 of the primary arm 110 and the moving pivot 174 are shown. In FIG. 5A, the housing 140 and the moving pivot 174 have rectangular or square cross-sections. The housing 140 is located inside of the moving pivot 174. The first shaft 142 may be positioned by one or more plates 180 to maintain a relative position of the first shaft 142. Grease such as dielectric grease may be used to reduce friction.

In FIG. 5B, the housing 140 and the moving pivot 174 have circular cross-sections. The housing 140 is located inside of the moving pivot 174. The first shaft 142 may be positioned by one or more plates 180 to maintain a relative position of the first shaft 142. The moving pivot 174 may include one or more radially inwardly directed projections 182 that are received by one or more of the slots 176 in the housing 140. The slots 176 and projections 182 prevent rotational movement when the first handle 144 is rotated. The moving pivot 174 may be manufactured as two or more parts that are connected together to allow the moving pivot 174 to be installed. Grease such as dielectric grease may be used to reduce friction.

Referring now to FIG. 5C, the second holder 130 is shown to include a first plate 190 connected to the secondary arm 120, a spacer 192 and a second plate 194 connected to the spacer 192. A bolt 196 with an eye 198 is rotated (for example using dielectric sticks) in one direction to engage the wedge member 74 and in an opposite direction to disengage the wedge member 74. One or more projections 200 may be attached to the first plate 190 or the second plate 194 to help locate a correct position for the wedge member 74 during tapping.

Figure 6:
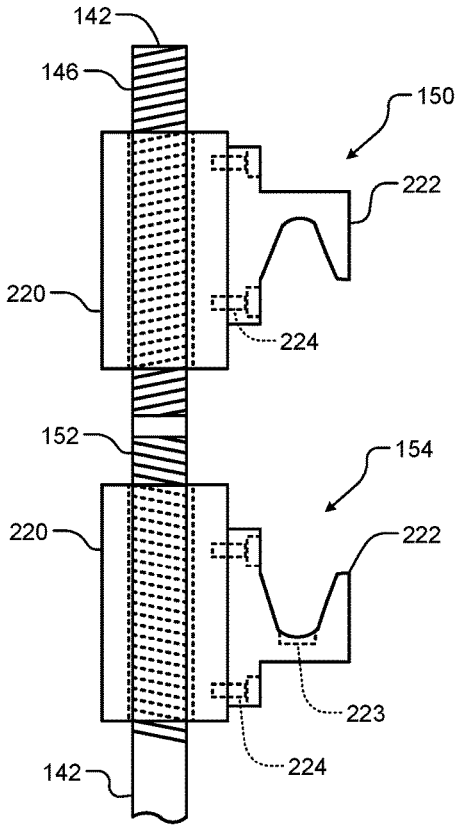
FIG. 6 is a side view illustrating an example of a first holder including first and second V-shaped holders that are attached to the primary arm for releasably holding the C-shaped member according to the present disclosure.

Referring now to FIG. 6, examples of the upper V-shaped holder 150 and the lower V-shaped holder 154 are shown. In this example, the upper V-shaped holder 150 and the lower V-shaped holder 154 include threaded portions 220 that receive the first shaft 142. The V-shaped portions 222 are attached to the threaded portions 220 using fasteners 224, welding, adhesive, etc. The V-shaped portions portion 222 for the lower V-shaped holder 154 may include a cavity 223 to receive a projecting end portion of the stirrup 64.

Figure 7:
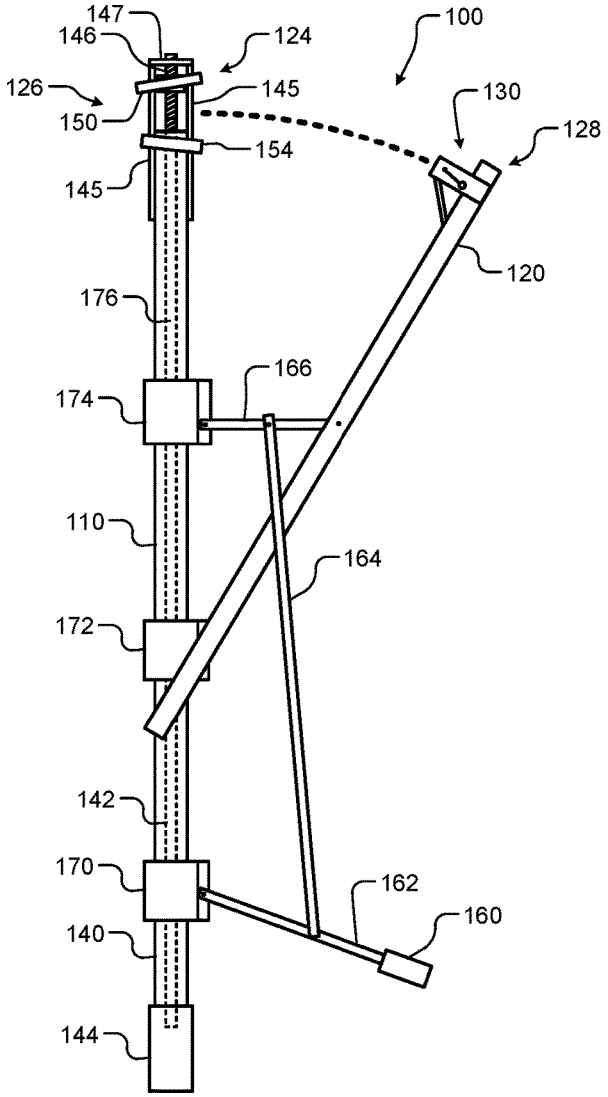
FIG. 7 is a side view illustrating another example of a hotstick tool that includes a first holder including a moveable upper holder and a fixed lower holder according to the present disclosure.

Referring now to FIG. 7, while the preceding examples show both the upper V-shaped holder 150 and the lower V-shaped holder 154 moving relative to the primary arm 110, one of the upper V-shaped holder 150 and the lower V-shaped holder 154 can be fixed. For example in FIG. 7, the lower V-shaped holder 154 is fixed relative to the primary arm 110.

Figure 8:
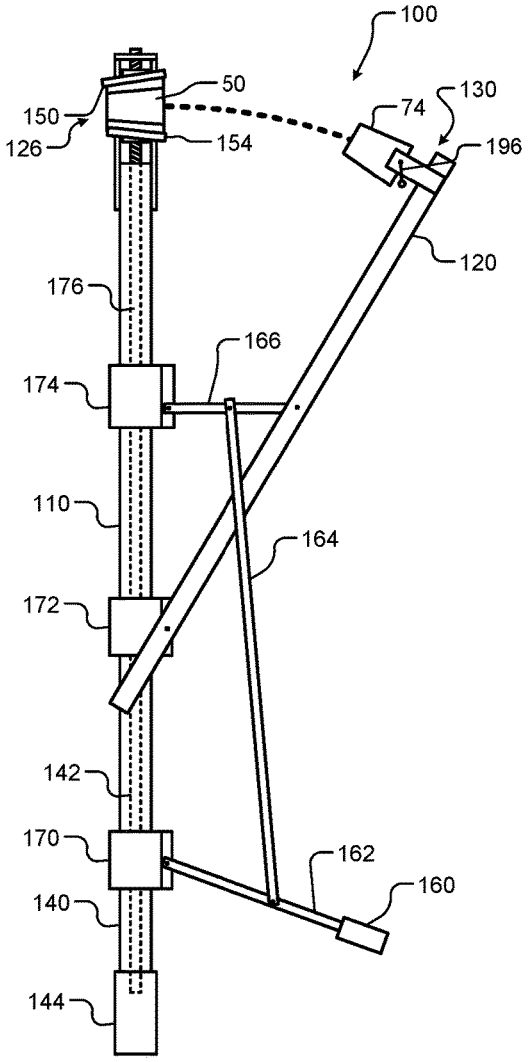
FIG. 8-9 are side views illustrating an example the hotstick tool of FIG. 4A holding a C-shaped member and a wedge member in first and second positions according to the present disclosure.
Figure 9:
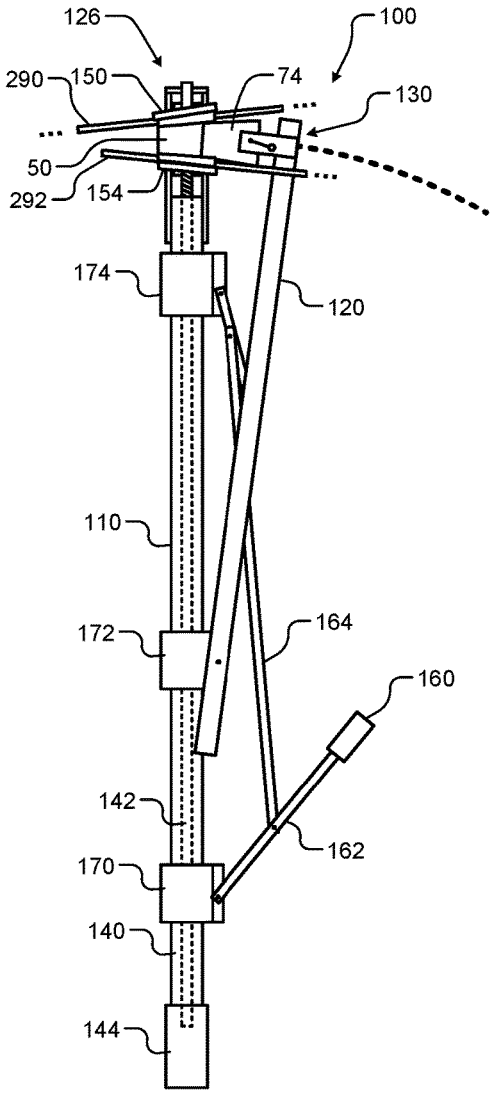

Referring now to FIG. 8-9, operation of the hotstick tool 100 is illustrated. The C-shaped member 50 is located between the upper V-shaped holder 150 and the lower V-shaped holder 154. The first handle 144 rotates the first shaft 142 until the upper V-shaped holder 150 and the lower V-shaped holder 154 engage the C-shaped member 50. The wedge member 74 may be partially inserted into the C-shaped member 50. The second handle 160 may be used to position the second holder 130 of the secondary arm 120 and to attach to the wedge member 74. Attaching in this manner ensures that the wedge member 74 will have the correct orientation when reinserted later. Then, the second handle 160 may be used to position the second holder 130 of the secondary arm 120 in an open position similar to that shown in FIG. 4A.

The lineman positions the hotstick tool 100 such that a main power line 290 is arranged in the upper channel 56 of the C-shaped member 50. A tap line 292 can be arranged in the lower channel 58 of the C-shaped member 50 or the stirrup 64 can be used. The second handle 160 is used to pivot the second holder 130 and position the wedge member 74 in the C-shaped member 50. Once positioned correctly, the bolt 196 is loosened on the second holder 130 to release the wedge member 74 and the secondary arm 120 is pivoted away.

The C-shaped member of the wedge driving tool is arranged around the C-shaped member 50 and the wedge member 74. The lineman applies impact force to the end of the tool to fire the shell, which seats the wedge member 74 in the C-shaped member 50. The first handle 144 rotates the first shaft 142 to move the first holder 126 to release the C-shaped member 50 and the hotstick tool 100 is removed from the main power line.

Figure 10:
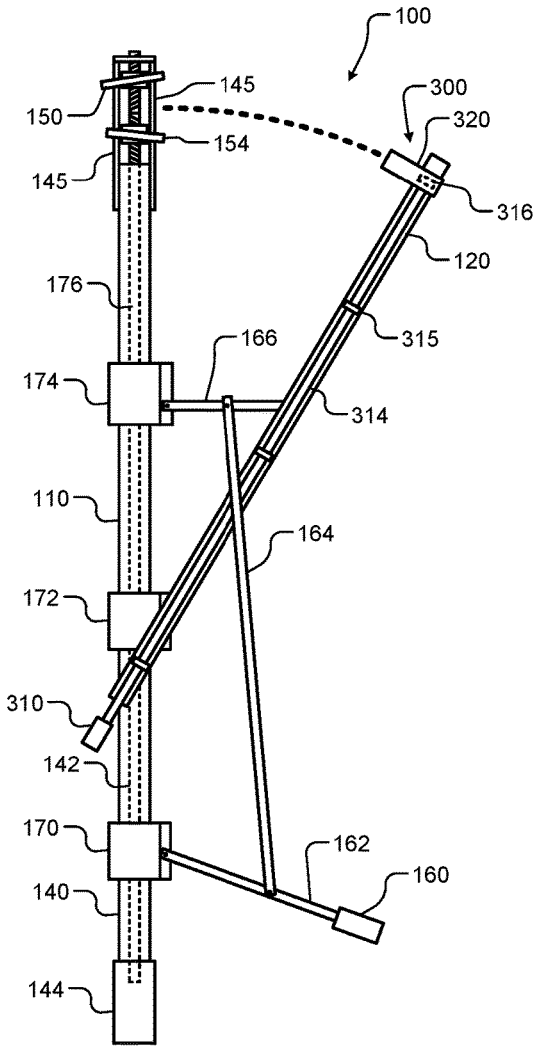
FIG. 10 is a side view illustrating another example of a hotstick tool including an alternative second holder for releasably engaging the wedge member according to the present disclosure.

Referring now to FIG. 10, another example of a second holder 300 is shown. The second holder 300 can be controlled using a third handle 310 connected to a shaft 314 arranged along the secondary arm 120. One or more guides 315 may be used to support the shaft 314 for rotation. A cam 316 is arranged at a distal end of the shaft 314 and is keyed or otherwise connected to the shaft 314. As the shaft 314 is rotated, the cam 316 biases a pivoting member 320 to engage or release the wedge member 74.

Figure 11:
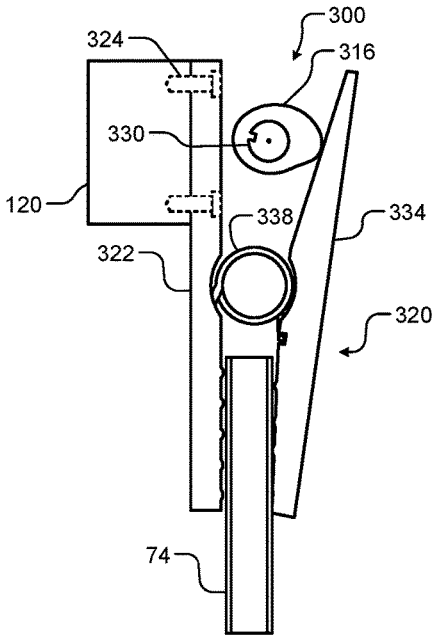
FIGS. 11-12 are plan views illustrating the second holder in engaged and released positions, respectively, according to the present disclosure.
Figure 12:
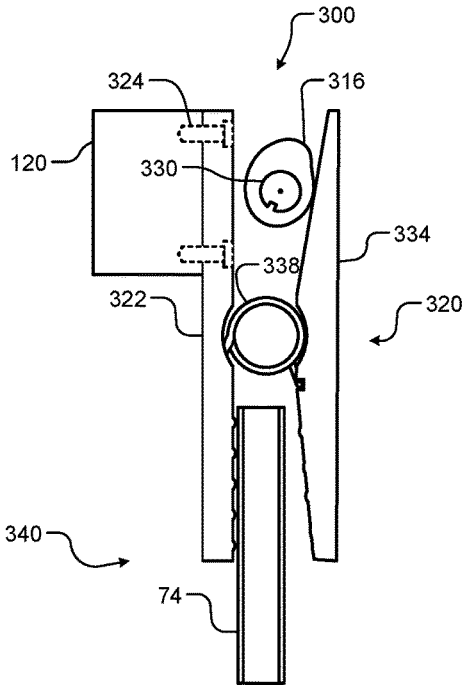

Referring now to FIGS. 11-12, the pivoting member 320 and the cam 316 are shown in more detail in closed and open positions. The pivoting member 320 includes a first plate 322 attached to the secondary arm 120. In some examples, one or more fasteners 324 are used. The cam 316 is attached to the shaft 314 using a key 330. The first plate 322 is rotatably connected to a second plate 334 by a spring 338. In this example, the spring 338 biases ends 340 of the first and second plates 322, 334 open. As the cam 316 rotates to a first position in FIG. 11, the cam 316 biases the second plate 334 to a closed position as shown in FIG. 11. As the cam 316 rotates to a second position, the cam 316 allows the second plate 334 to return to an open position as shown in FIG. 12.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A hotstick tool for assisting a lineman when tapping power lines using a wedge tap connector, comprising:
- a primary arm including a first holder to releasably engage a C-shaped member of the wedge tap connector;
- a secondary arm that includes a second holder to releasably engage a wedge member of the wedge tap connector; and
- a pivoting linkage system guiding movement of the secondary arm relative to the primary arm to insert the wedge member into the C-shaped member,
- wherein the first holder includes:
- an upper V-shaped holder that is moveable relative to the primary arm; and
- a lower V-shaped holder that is one of:
  - fixed relative to the primary arm; and
  - moveable relative to the primary arm.

2. The hotstick tool of claim 1, wherein the lower V-shaped holder is moveable relative to the primary arm and further comprising:
- a shaft located in the primary arm and including:
  - a first threaded portion located at a distal end thereof and engaging a first threaded portion of the upper V-shaped holder; and
  - a second threaded portion arranged adjacent to the first threaded portion and engaging a second threaded portion of the upper V-shaped holder,
- wherein the first threaded portion is oriented opposite to the second threaded portion such that:
  - rotation of the shaft in one direction moves the upper V-shaped holder towards the lower V-shaped holder; and
  - rotation of the shaft in an opposite direction moves the upper V-shaped holder away from the lower V-shaped holder.

3. The hotstick tool of claim 1, wherein the lower V-shaped holder is fixed relative to the primary arm and further comprising:
- a shaft located in the primary arm and including a first threaded portion located at a distal end thereof and engaging a first threaded portion of the upper V-shaped holder,
- wherein rotation of the shaft in one direction moves the upper V-shaped holder towards the lower V-shaped holder and rotation of the shaft in an opposite direction moves the upper V-shaped holder away from the lower V-shaped holder.

4. The hotstick tool of claim 1, wherein the primary arm and the secondary arm are made of a dielectric material.

5. The hotstick tool of claim 1, wherein the pivoting linkage system includes:
- a handle;
- a first linkage connected to the handle; and
- a first fixed pivot connected to the primary arm and pivotally connected to the first linkage.

6. The hotstick tool of claim 5, wherein the pivoting linkage system further includes:
- a second fixed pivot connected to the primary arm and pivotally connected to the secondary arm; and
- a first moving pivot slidably connected to the primary arm.

7. The hotstick tool of claim 6, wherein the pivoting linkage system further includes:
- a second linkage pivotally connecting the first moving pivot and the secondary arm; and
- a third linkage pivotally connecting the first linkage to the second linkage.

8. A hotstick tool for assisting a lineman when tapping power lines using a wedge tap connector, comprising:
- a primary arm including a first holder to releasably engage a C-shaped member of the wedge tap connector;
- a secondary arm that includes a second holder to releasably engage a wedge ember of the wedge tap connector; and
- a pivoting linkage system guiding movement of the secondary arm relative to the primary arm to insert the wedge member into the C-shaped member,
- wherein the second holder includes:
- a first plate connected to the secondary arm;
- a second plate spaced from the first plate; and
- a bolt received in a bore in the second plate.

9. The hotstick tool of claim 8, wherein the primary arm and the secondary arm are made of a dielectric material.

10. The hotstick tool of claim 8, wherein the pivoting linkage system includes:
- a handle;
- a first linkage connected to the handle; and
- a first fixed pivot connected to the primary arm and pivotally connected to the first linkage.

11. A hotstick tool for assisting a lineman when tapping power lines using a wedge tap connector, comprising:
- a primary arm including a first holder to releasably engage a C-shaped member of the wedge tap connector;
- a secondary arm that includes a second holder to releasably engage a wedge member of the wedge tap connector; and
- a pivoting linkage system guiding movement of the secondary arm relative to the primary arm to insert the wedge member into the C-shaped member,
- wherein the second holder includes:
- a pivoting member including a first plate connected to the secondary arm, wherein the first plate pivots relative to a second plate.

12. The hotstick tool of claim 11, further comprising:

a spring biasing at least one of the first plate and the second plate in a first direction; and a shaft arranged adjacent to the secondary arm.

13. The hotstick tool of claim 12, further comprising a cam connected to a distal end of the shaft to bias at least one of the first plate and the second plate in a second direction opposite to the first direction.

14. The hotstick tool of claim 11, wherein the primary arm and the secondary arm are made of a dielectric material.

15. The hotstick tool of claim 11, wherein the first holder includes:

an upper V-shaped holder that is moveable relative to the primary arm; and a lower V-shaped holder that is one of:

moveable relative to the primary arm; and fixed relative to the primary arm.

16. A hotstick tool for assisting a lineman when tapping power lines using a wedge tap connector, comprising:

a primary arm including a first holder to releasably engage a C-shaped member of the wedge tap connector;

a secondary arm that includes a second holder to releasably engage a wedge member of the wedge tap connector; and a pivoting linkage system guiding movement of the secondary arm relative to the primary arm to insert the wedge member into the C-shaped member, wherein the pivoting linkage system includes:

a handle;

a first linkage connected to the handle; and a first fixed pivot connected to the primary arm and pivotally connected to the first linkage.

17. The hotstick tool of claim 16, wherein the pivoting linkage system further includes:

a second fixed pivot connected to the primary arm and pivotally connected to the secondary arm; and a first moving pivot slidably connected to the primary arm.

18. The hotstick tool of claim 17, wherein the pivoting linkage system further includes:

a second linkage pivotally connecting the first moving pivot and the secondary arm; and a third linkage pivotally connecting the first linkage to the second linkage.

19. The hotstick tool of claim 16, wherein the primary arm and the secondary arm are made of a dielectric material.

20. The hotstick tool of claim 16, wherein the first holder includes:

an upper V-shaped holder that is moveable relative to the primary arm; and a lower V-shaped holder that is one of:

moveable relative to the primary arm; and fixed relative to the primary arm.

* * * * *